US007581358B2

(12) United States Patent
Wrightman

(10) Patent No.: US 7,581,358 B2
(45) Date of Patent: Sep. 1, 2009

(54) ROOF CONSTRUCTION

(76) Inventor: Robert Wrightman, P.O. Box 2169, Winhara Rd., Bracebridge, Ontario (CA) P0B 1C0

( * ) Notice: Subject to any disclaimer, the term of this patent is extended or adjusted under 35 U.S.C. 154(b) by 657 days.

(21) Appl. No.: 10/858,078

(22) Filed: Jun. 2, 2004

(65) Prior Publication Data

US 2005/0268563 A1 Dec. 8, 2005

(51) Int. Cl.
*E04B 7/06* (2006.01)

(52) U.S. Cl. ..... 52/90.1; 52/90.2; 52/18; 52/643; 52/639; 52/276

(58) Field of Classification Search ..... 52/90.1, 52/236.3, 276, 18, 653.2, 93.2, 66, 272, 648.1, 52/639, 90.2, 643, 94, 22, 73, 41, 638, 637, 52/93.1; D25/17, 19, 27, 23; 248/237; 446/476, 446/478

See application file for complete search history.

(56) References Cited

U.S. PATENT DOCUMENTS

| | | | | | |
|---|---|---|---|---|---|
| 316,859 | A * | 4/1885 | Agee | 119/521 |
| 397,535 | A * | 2/1889 | Carroll | 52/276 |
| 768,335 | A * | 8/1904 | Loehle | 52/18 |
| 1,433,490 | A * | 10/1922 | Stitt | 52/18 |
| D78,804 | S * | 6/1929 | Beckwith | D25/17 |
| 1,737,371 | A * | 11/1929 | Hamm et al. | 52/18 |
| 2,001,215 | A * | 5/1935 | Ruppel | 52/653.2 |
| 2,290,195 | A * | 7/1942 | Macmillan | 52/18 |
| 2,365,579 | A * | 12/1944 | Mulligan | 52/92.3 |
| D187,730 | S * | 4/1960 | Barancik | D25/17 |
| 2,931,129 | A * | 4/1960 | Boniface | 446/126 |
| 3,019,861 | A * | 2/1962 | Rasch et al. | 52/639 |
| D204,239 | S * | 4/1966 | Upor | D25/23 |
| 3,423,898 | A * | 1/1969 | Coloney et al. | 52/713 |
| 3,564,802 | A * | 2/1971 | Dreyfus | 52/637 |
| 3,685,221 | A * | 8/1972 | Mangan | 52/80.1 |
| 4,083,155 | A * | 4/1978 | Lampert | 52/93.1 |
| 4,335,555 | A * | 6/1982 | Southerland et al. | 52/639 |
| 4,516,363 | A * | 5/1985 | Beaulieu et al. | 52/92.1 |
| 4,610,114 | A * | 9/1986 | Rodriguez | 52/93.1 |
| 4,622,787 | A * | 11/1986 | Scott | 52/58 |
| 4,648,217 | A * | 3/1987 | Watson | 52/92.3 |
| 5,297,374 | A * | 3/1994 | Himes | 52/641 |
| 5,542,227 | A * | 8/1996 | Frayne | 52/639 |
| 5,655,335 | A * | 8/1997 | Vermeer | 52/66 |
| 5,950,374 | A * | 9/1999 | Gromat | 52/93.2 |
| 5,966,890 | A * | 10/1999 | Inman | 52/653.2 |
| 6,067,771 | A * | 5/2000 | Blankenship | 52/745.2 |
| 6,199,341 | B1 * | 3/2001 | Carlin et al. | 52/653.1 |
| 6,519,900 | B1 * | 2/2003 | Pierce | 52/66 |
| 6,568,134 | B2 * | 5/2003 | Kerney | 52/90.1 |

* cited by examiner

*Primary Examiner*—Phi Dieu Tran A
(74) *Attorney, Agent, or Firm*—John R. S. Orange; Brett J. Slaney; Blake, Cassels & Graydon LLP

(57) ABSTRACT

A roof construction has a primary ridge member with a king post depending from the ridge member. A pair of secondary ridge members are secured in sockets in the king post at different heights.

12 Claims, 5 Drawing Sheets

FIG. 6.
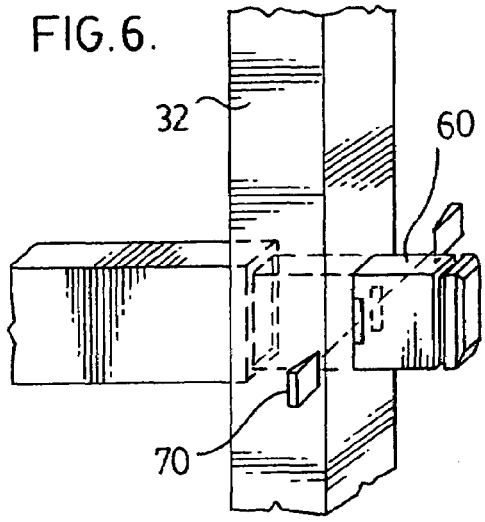
FIG. 7.
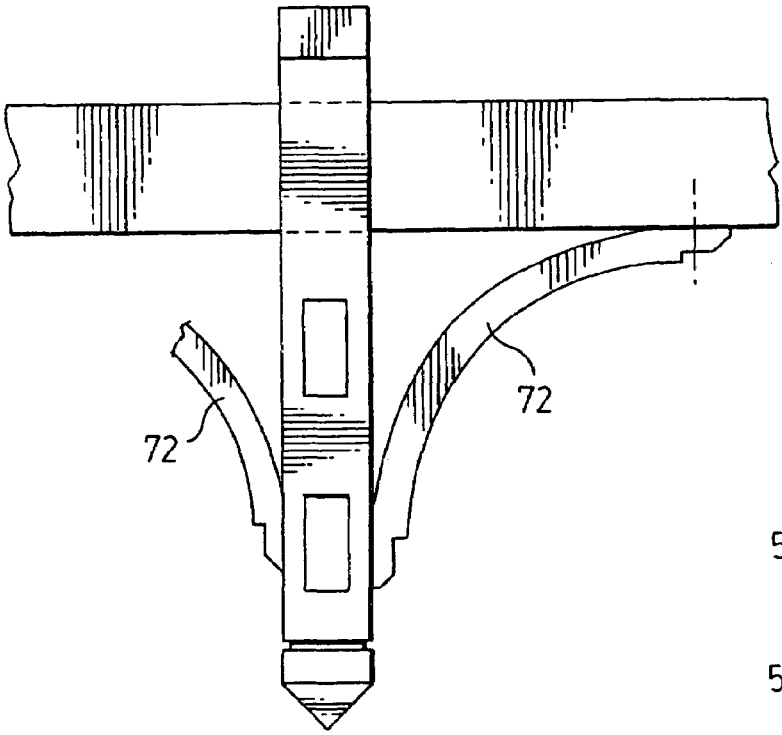
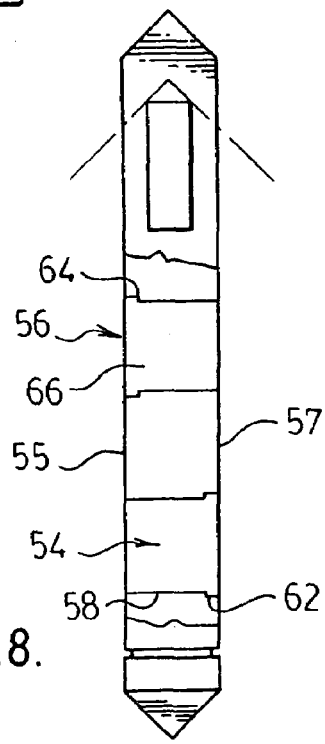
FIG. 8.

ROOF CONSTRUCTION

FIELD OF THE INVENTION

The present invention relates to roof constructions.

BACKGROUND OF THE INVENTION

Roofs for buildings are typically formed from a framework of supporting members extending between the sidewalls and providing an inclined surface to shed water. A typical roof construction has a ridge with rafters running perpendicular to the ridge to the top of the sidewalls. An impermeable covering is then attached to the rafters, either directly or on top of sheathing so that a stable water-tight structure is obtained.

Ceilings are usually provided beneath the roof by horizontal joists running between vertical walls to which a horizontal ceiling material is secured. In many applications however, it is preferred that a cathedral ceiling is provided in which the ceiling material runs parallel to the ceiling joist. In some cases, it is desirable that the rafters are exposed for aesthetic reasons in which case the sheathing material may be secured to the topside of the rafters leaving the body of the rafter exposed from within the building.

The use of a cathedral ceiling provides an open interior that is favoured in many designs. However, cathedral ceilings do not particularly lend themselves to the incorporation of one or more intersecting galleries. The intersection of the roofs in the galleries requires an arrangement of rafters to provide support for the intersecting ridges that is structurally complex or visually unattractive or, the use of tie beams to support the ridges of the intersecting hip galleries. The tie beams however, encumber the interior space and visually are not as elegant as the unencumbered cathedral design. Typically, the structure utilises a post extending from the floor to the hinge to provide support. However, this encumbers the floor plan and interrupts the open area within the building.

It is therefore an object of the present invention to provide a roof construction in which the above disadvantages are obviated or mitigated.

SUMMARY OF THE INVENTION

In general terms, the present invention provides a roof construction in which a king post is suspended from a primary ridge and at least one other secondary ridge is supported by the king post below the primary ridge.

Preferably, a pair of secondary ridges are secured to opposite sides of the king post at different levels and as a further preference, the secondary ridge is extended orthogonally to the primary ridge.

BRIEF DESCRIPTION OF THE DRAWINGS

An embodiment of the invention will now be described by way of example only with reference to the accompanying drawings in which:

FIG. 6 is a detailed view of a portion of the structure shown in FIG. 2.

FIG. 7 is a view in the direction of arrow A of FIG. 2.

FIG. 8 is a view on the line VIII-VIII of FIG. 7.

DETAILED DESCRIPTION OF THE INVENTION

Figure 1:
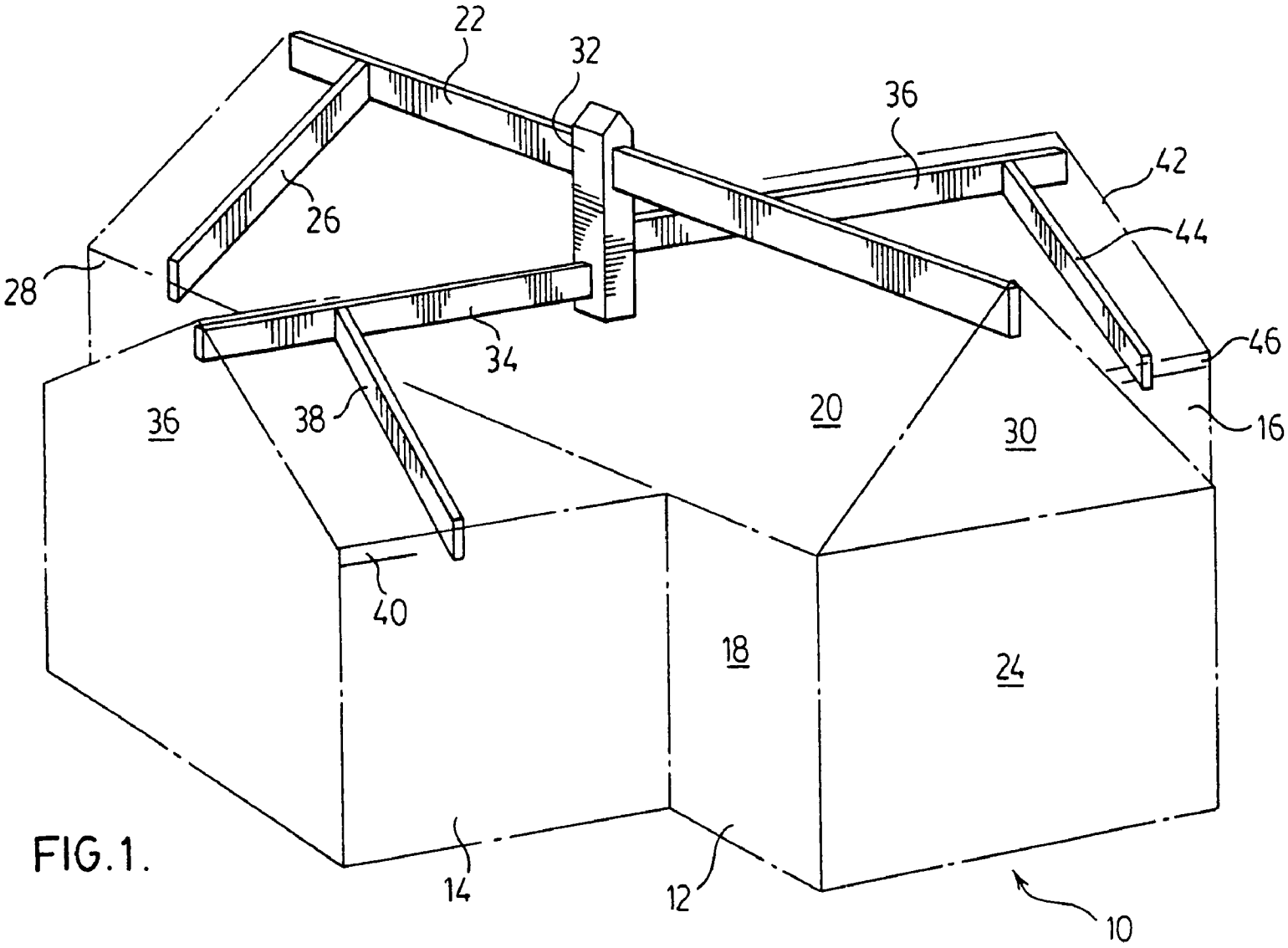
FIG. 1 is a schematic representation of a building.
Figure 2:
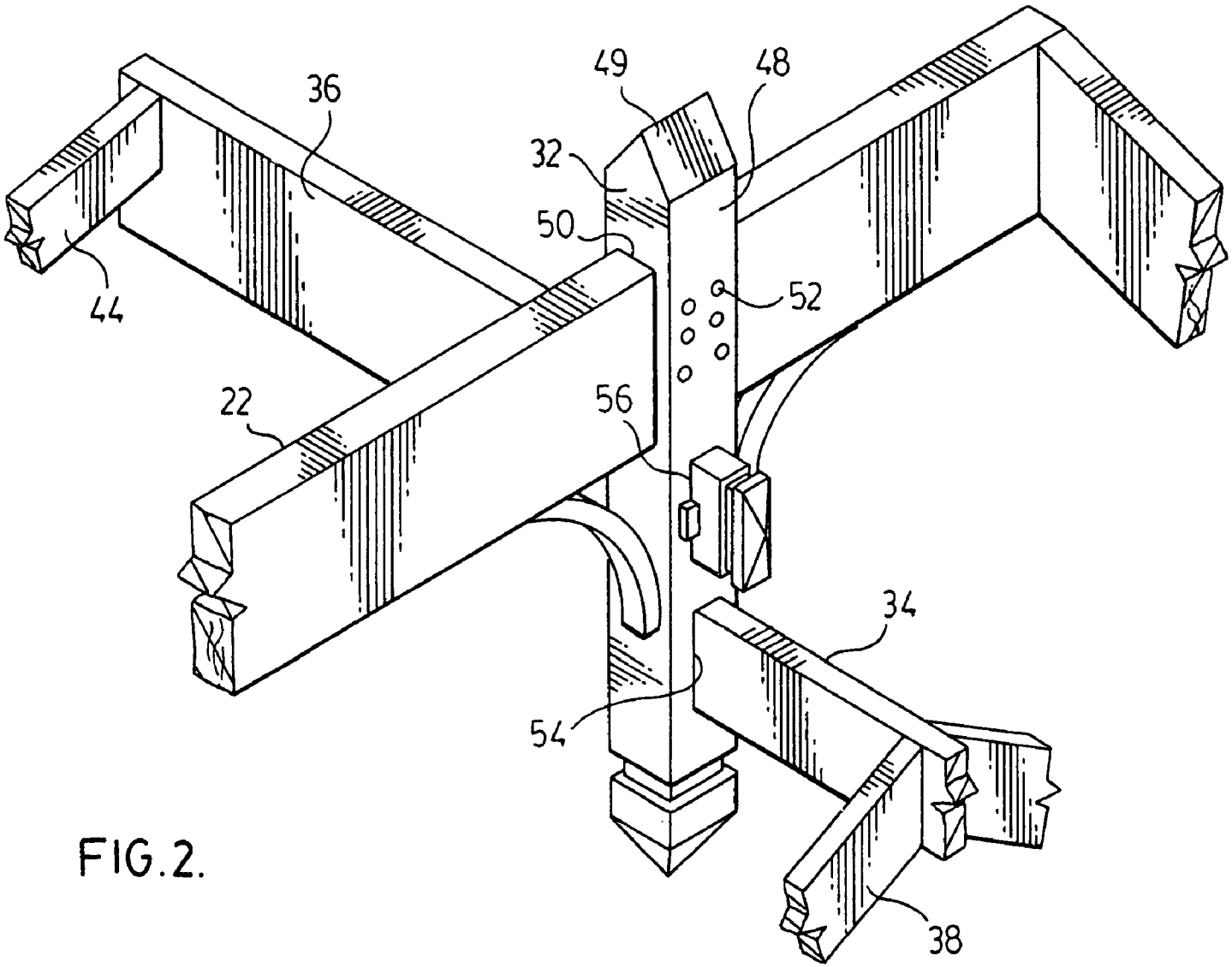
FIG. 2 is an enlarged view of a portion of the roof structure shown in FIG. 1.
Figure 3:
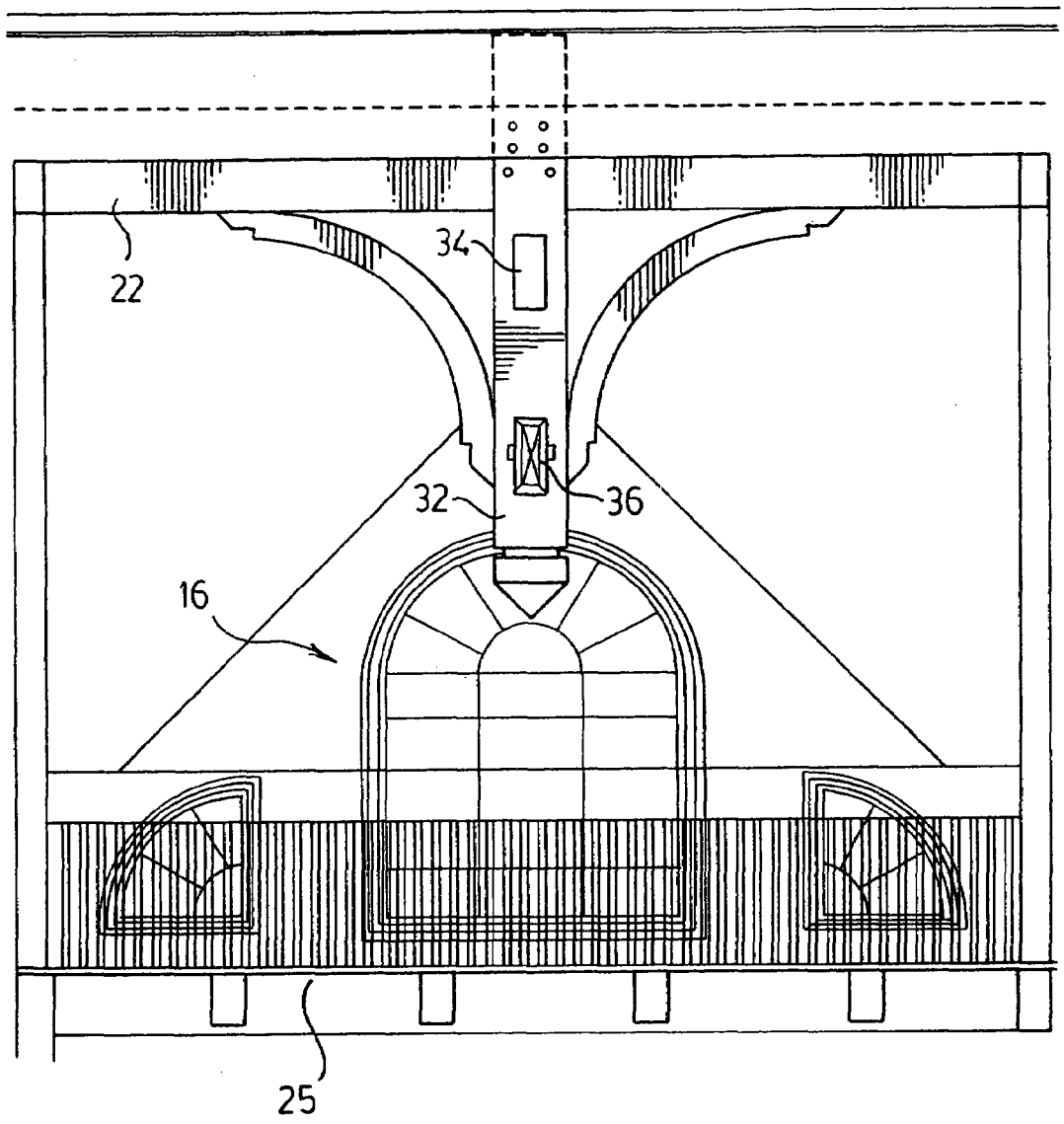
FIG. 3 is a view on the line III-III of FIG. 1.
Figure 4:
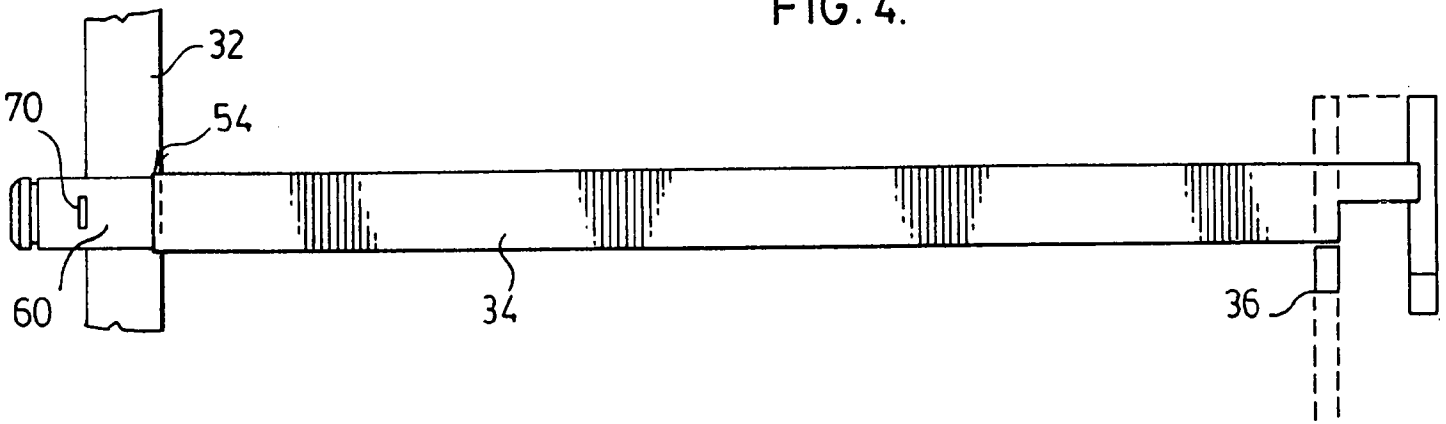
FIG. 4 is a view on the line IV-IV of FIG. 1.
Figure 5:
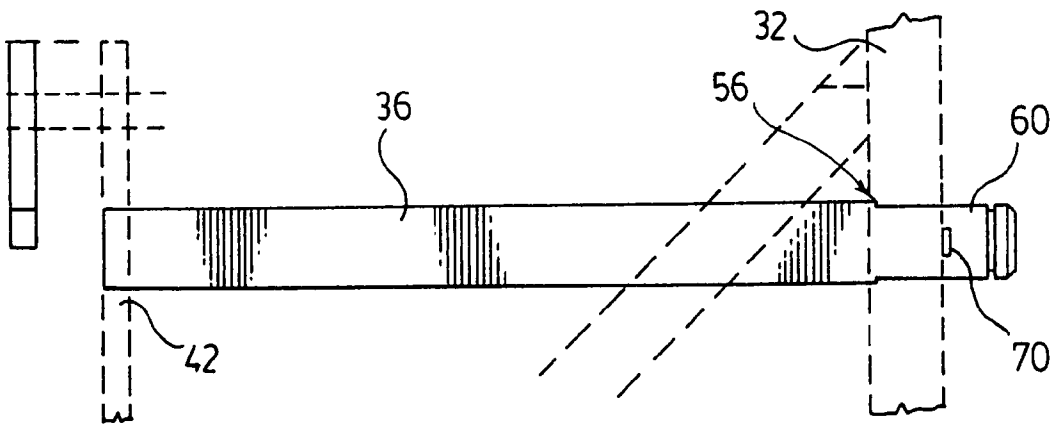
FIG. 5 is a view on the line V-V of FIG. 1.

Referring therefore to the drawings, a building generally indicated 10 has a main gallery 12 and side galleries 14, 16. Each of the galleries 12, 14, 16 is defined by sidewalls 18 supporting pitched roof structures 20, 22, 24 respectively. The wall structures 18 may be of any conventional form such as frame construction, masonry, or log construction depending upon the particular type of building. As may be seen in FIG. 3, a balcony 25 extends across the gallery 16 to provide a vantage point to view the interior of the main gallery 12.

The roof structure 20 includes a primary ridge member 22 extending between endwalls 24 and supported in an elevated position by gable ends 30. Inclined rafters 26 extend from top plates 28 to the primary ridge 22 and are secured by suitable fastenings such as nails, spikes, or bolts. The rafters 26 may be supported on the upper surface of the ridge 22, as shown and may be cut to provide support for the rafters through conventional birdmouths or the like. The rafters 26 run at right angles to the axis of the ridge member 22.

A king post 32 is located on the primary ridge member 22 and depends from the ridge member 22. The king post 32 is located on the center line of the intersection of the galleries 14, 16 and is used to support respective front and rear ridge members 34, 36 so that they are suspended from the ridge number 22. The front ridge member 34 is supported on the gable end 38 of the gallery 14 and rafters 38 on the sidewalls 18*a*.

Similarly, the rear ridge member 36 extends from the king post 32 to the gable end 42 of the rear gallery 16 where it is supported by suitable support structure. Rafters 44 extend from the rear ridge member 36 to the top plate 46 to support roof sheathing.

The details of the king post and its connection to the ridge members 22, 34, 36 can best be seen in FIGS. 2 through 8. The king post 32 is built up from multiple plies 48 to form a solid structure of the required cross-section. Of course, a solid stock may be used as an alternative. A rectangular opening 50 is formed in the king post 32 and is dimensioned to receive the main ridge beam with a sliding fit. The aperture 50 may be formed with conventional wood working techniques by drilling and routing the opening through the post 32. The king post 32 is secured to the main ridge beam by through bolts 52 that pass through the king post and the main ridge beam to locate it axially. The upper end 49 of the post 32 is cut at an angle to conform to the upper edge of the rafters 26.

An aperture 54 is formed in the king post 32 between oppositely directed side faces 55, 57 to receive one end of the front ridge beam 34. Similarly, an aperture 56 is formed between the side faces 55, 57 intermediate the ridge beam 22 and the aperture 54 to receive the rear ridge beam 36. The apertures 54, 56 are similar in construction although oriented in opposite directions.

Referring therefore to FIG. 8, the aperture 54 has a through mortice 58 dimensioned to receive a tail portion of the ridge beam 34 as will be described in more detail below. A rabbet 62 is formed around the mortice 58 in the side face 55 facing the front ridge beam 34. It will be appreciated that a similar rabbet 64 is formed in a mortice 66 forming aperture 56 in the face 57 to receive the rear ridge beam 36. The periphery of the rabbets 62, 64 correspond to the cross-section of the respective ridge beams 34, 36. Each of the ridge beams 36, 38 has a tail portion 60 as can be seen in FIG. 6, that is formed by removing the flanks of the ridge beams by a thickness corresponding to the width of the rabbet 62 so that the tails 60 are a smooth sliding fit within the mortices 58, 66. The shoulder formed at the intersection of the ridge beam and tail thus is a snug fit within the rabbet 62 and locates the front ridge beam 34 within the king post 32. Each of the tails 60 project through the king post 32 and have a slot 68 to receive wedges 70.

Wedges 70 are retained in situ by a fastener, such as a screw, that passes through the wedges and is received in the body of the king post 32.

The king post 32 is also stabilized with respect to the main ridge member 22 by braces 74 secured at one end to the main ridge member 22 and the opposite end to the king post 32. The braces 72 are shown as arcuate but may of course be alternative configurations.

In order to assemble the roof structure 20, the king post 32 is slid along the primary ridge member 22 which is then supported in the gable ends 30. The king post 32 is located at the intended position of the front and rear ridge members 34, 36 and may be either temporarily or permanently secured by means of the bolts 52. The tail of the front ridge member 34 and rear ridge member 36 are then inserted into respective apertures 54, 56 and the opposite ends located in the gables 38, 42 respectively. The shoulders on each of the ridge members is located within the rabbets 62, 64 and wedges inserted in the slots 68. The wedges are then driven into the slot and the bolts 52 secured to locate the king post on the primary ridge 22 if not previously attached. The braces 72 are then secured to maintain the king post 32 in a vertical disposition and inhibit lateral or pivotal movement that could translate into longitudinal displacement of the front and rear ridge members.

With the ridge members secure, the rafters may be laid up to the ridge and the sheathing completed in a conventional manner.

The interior of the galleries is maintained relatively open with only the single vertical king pin interrupting the unencumbered ceiling line of the structure. A support post is not required allowing an open floor plan.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A roof having a primary ridge member supported at spaced locations, a king post extending vertically beneath said primary ridge member intermediate said spaced locations, a secondary ridge member extending from said king post at a location spaced from said primary ridge member and in a direction generally transverse thereto, said secondary ridge member being secured to said king post for transfer of load to said primary ridge member, and a plurality of inclined roof elements each having an upper end supported on respective ones of said ridge members.

2. A roof according to claim 1 including a brace extending between said primary ridge member and said king post.

3. A roof according to claim 1 wherein one end of said secondary ridge member is secured in an aperture provided in said king post.

4. A roof according to claim 3 wherein said one end of said secondary ridge member extends through said king post.

5. A roof according to claim 4 wherein said one end is of reduced cross-section and a shoulder is formed in said aperture to inhibit relative movement between said king post and secondary ridge member.

6. A roof according to claim 1 wherein said primary ridge member extends through an aperture in said king post.

7. A roof according to claim 6 wherein a brace extends between said king post and said primary ridge member.

8. A roof according to claim 7 wherein said king post is mechanically secured to said primary ridge member.

9. A roof according to claim 8 wherein said secondary ridge member extends through an aperture formed in said king post.

10. A roof according to claim 1 wherein a pair of secondary ridge members are secured to said king post at respective locations spaced from said primary ridge member and extending to opposite sides of said king post.

11. A roof according to claim 10 wherein a respective end of each of said secondary ridge members is secured in apertures in said king post.

12. A roof according to claim 11 wherein said apertures have oppositely directed shoulders to locate axially said ridge members.

* * * * *